United States Patent [19]

Furusawa et al.

[11] 4,431,445

[45] Feb. 14, 1984

[54] STEEL FOR MACHINE CONSTRUCTION HAVING EXCELLENT COLD FORGEABILITY AND MACHINABILITY

[75] Inventors: Sadayoshi Furusawa; Hideo Takeshita; Tsuyoshi Kohoka; Jiro Koarai; Shuji Iwata, all of Kobe, Japan

[73] Assignee: Kabushiki Kaisha Kobe Seiko Sho, Kobe, Japan

[21] Appl. No.: 281,675

[22] Filed: Jul. 9, 1981

[30] Foreign Application Priority Data

Jul. 9, 1980 [JP] Japan ..... 55-93499
Jul. 9, 1980 [JP] Japan ..... 55-93500
Jul. 9, 1980 [JP] Japan ..... 55-93501

[51] Int. Cl.[3] ..... C22C 38/00; C22C 38/18; C22C 38/40

[52] U.S. Cl. ..... 75/123 R; 75/123 F; 75/126 G; 75/128 E

[58] Field of Search ..... 75/123 F, 123 R, 126 E, 75/126 G, 128 E

[56] References Cited

U.S. PATENT DOCUMENTS 3,155,495 11/1964 Nakamura ..... 75/126 E
4,115,111 9/1978 Itoh et al. ..... 75/126 G
4,153,454 5/1979 Emi et al. ..... 75/128 E
4,279,646 7/1981 Kato et al. ..... 75/128 E

FOREIGN PATENT DOCUMENTS 594206 2/1978 U.S.S.R. ..... 75/128 E

*Primary Examiner*—Peter K. Skiff
*Attorney, Agent, or Firm*—Oblon, Fisher, Spivak, McClelland & Maier

[57] ABSTRACT

A steel for machine construction having excellent cold forgeability and machinability, the steel having a composition of below 0.6% C, below 0.35% Si, below 1.65% Mn, below 3.5% Ni, below 3.5% Cr, below 0.35% Mn, 0.010–0.10% Al and below 0.002% B, the rest being Fe and impurities with limited contents of Ca in the range of 0.0005–0.05%, S of below 0.12% and $Al_2O_3$ inclusion of below 0.002%.

1 Claim, 4 Drawing Figures

STEEL FOR MACHINE CONSTRUCTION HAVING EXCELLENT COLD FORGEABILITY AND MACHINABILITY

BACKGROUND OF THE INVENTION

1. Field of the Invention

This invention relates to improvements in alloy steels. More particularly, it relates to steels for machine construction having excellent cold forgeability and machinability.

2. Description of the Prior Art

Most of machine parts have hitherto been fabricated by cutting operations. In order to reduce the cost of processing of the parts, there are frequently being adopted, with the recent advancement of cold work techniques, processes which include rough shaping by cold work and then finishing by cutting operation. To this end, there are required steels which have excellent characteristics both in cold forgeability and machinability.

In order to impart good cold forgeability to steels, it is the general practice that steels are subjected to the spheroidizing and annealing treatment or to a method of lowering cleanliness thereof. However, this leads to poor machinability of the steel. On the other hand, it is known to add S or Pb to steels so as to improve the machinability with the attendant disadvantage that the cold forgeability of steel becomes poor. As will be appreciated from the above, the cold forgeability and the machinability are, in most cases, contrary to each other and it is generally accepted that these properties are incompatible with each other.

In general, carbon steels or alloy steels for machine construction contain S in an amount of about 0.015-about 0.030%, most of the sulfur being present in steel in the form of MnS. The MnS is usually distributed unevenly in steel and tends to be excessively elongated upon rolling, causing the anisotropy of mechanical properties and deteriorating the cold forgeability (these inclusions in steel are defined as A-system inclusion in the JIS Standards). Al is ordinarily added for deoxidation or regulation of grain size into molten steel. Even after solidification of the molten steel, Al is contained in the form of $Al_2O_3$ at a level of about 40–100 ppm and causes the development of incipient cracks within steel at the time of cold work, thus deteriorating the cold forgeability and accelerating the abrasion of tools at the time of cutting operations because of its high hardness (these inclusions are defined in JIS Standards as B-system inclusion).

Then, known Ca-deoxidized steel and lead free-cutting steels will be explained. The Ca-deoxidized steels are those which are obtained by deoxidizing molten steel with Ca to form Ca oxides such as anorthite ($CaO.Al_2O_3.2SiO_2$), gehlenite ($2CaO.Al_2O_3.SiO_2$) and the like, by which at the time of cutting, the deposit called belag is formed on the surfaces of tool to supress the tool abrasion. In some Ca-deoxidized steels, the Ca oxide may be $CaO.nAl_2O_3$. The lead free-cutting steels comprises 0.15–0.30% of Pb which is present in the form of a single inclusion, or compound inclusions with sulfides or oxides. This Pb inclusion shows the effect of stress concentration and the lubricating action on tool at the time of cutting to improve the machinability. In this connection, however, ordinarily employed lead free-cutting steels, for example, S45CL, contain sulfur in an amount ranging 0.015 to 0.030%, most of which is present in the form of MnS. This MnS is elongated upon rolling and is turned as the A-system inclusion. Additionally, Pb is readily converted into a large-sized compound inclusion in combination with MnS, leading to the deterioration of cold forgeability.

The alloy steels of the type to which the present invention is directed are known, for example, in Japanese Patent Publication Nos. 46-27661 and 54-33206, Japanese Laid-open Application No. 53-22112, Great Britain Pat. Nos. 874,488 and 717,896 Norwegian Pat. No. 123,551, German Pat. (DE-OS) Nos. 1,036,297, 1,905,247 and 1,918,702, and U.S. Pat. No. 3,110,586 and 3,424,576.

SUMMARY OF THE INVENTION

It is accordingly an object of the present invention to provide an alloy steel for machine construction which overcomes the disadvantages of the prior art described above.

It is another object of the invention to provide the alloy steel for machine construction which has excellent cold forgeability and machinability.

It is a further object of the invention to provide the alloy steel for machine construction in which inclusions are finely dispersed in the steel in suitable forms whereby the cold forgeability and machinability are improved.

The above objects can be achieved, according to the invention, by a steel for machine construction having excellent cold forgeability and machinability, the steel having the composition of below 0.6% C, below 0.35% Si, below 1.65% Mn, below 3.5% Ni, below 3.5% Cr, below 0.35% Mo, 0.010–0.10% Al and below 0.002% B, the rest being Fe and impurities with the limited contents of Ca in the range of 0.0005–0.05%, S of below 0.12% and $Al_2O_3$ inclusion of below 0.002%. In a preferred aspect, at least one of Pb and Bi is further contained in the steel in the form of compounds, metals or alloys in predetermined ranges of amount.

The above and other objects, features and advantages of the invention will become apparent from the following description and the appended claims, taken in conjunction with the accompanying drawings.

DETAILED DESCRIPTION OF THE INVENTION AND PREFERRED EMBODIMENTS

Figure 1:
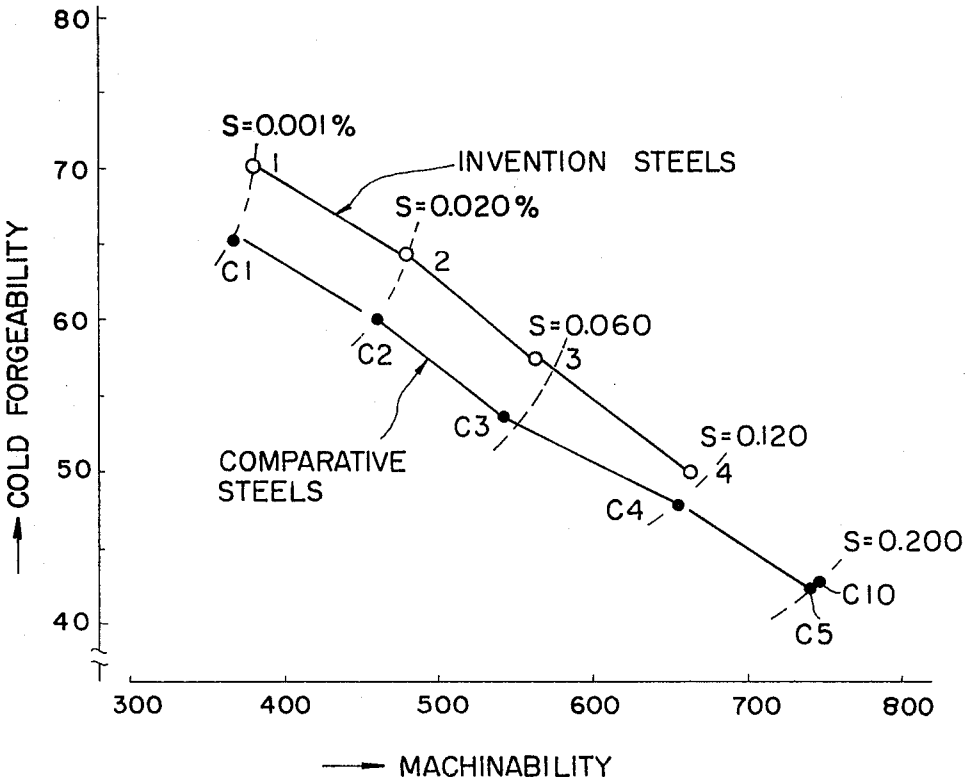
FIG. 1 is a graphical representation of the cold forgeability and machinability of the steel of the invention and a known steel for different S contents of the respective steels.

In order to impart excellent cold forgeability and machinability to the steels for machine construction according to the present invention, a large amount of Ca is continuously added to molten steel, so that sulfur (S) present in the molten steel is converted into CaS and (Ca, Mn)S and $Al_2O_3$ is completely removed or reduced to a very small extent by reduction reaction with Ca.

The above can be expressed by the following reaction formulas.

$$Ca+S \rightarrow CaS$$

$$Ca+Mn+S \rightarrow (Ca,Mn)S$$

$$3Ca+Al_2O_3 \rightarrow 3CaO+2Al$$

As will be seen from the above, in the steel according to the invention, the sulfides in the steel are converted from those mainly composed of MnS as in known steels into CaS and (Ca,Mn)S, which are resistant to extend at the time of processings such as rolling. By this, the anisotropy of the steel material is mitigated with the attendant improvement in cold forgeability and machinability.

It is general to add Al alloys at the time of making steel for deoxidization and adjustment of grain size. Part of the Al alloy is converted into $Al_2O_3$ and the addition of Ca results in a considerable reduction of the $Al_2O_3$ inclusion. This is also effective in improving the machinability and cold forgeability synergistically with the sulfide conversion described above.

In accordance with a preferred aspect of the invention, when one or two of Pb and Bi are added to the steel in small amounts in the form of compounds, elemental metals or alloys to form a single inclusion of Pb or Bi or finely deposit around the sulfides or CaO inclusion, it has been found that the cold forgeability and machinability can be improved by the synergistic effect or action of these metals with other inclusions.

The constituents their contents and inclusions of the steel for machine construction of the invention with excellent cold forgeability and machinability will be described. It will be noted here that the for machine construction include carbon steels and alloy steels for machine constructions and have generally compositions of below 0.6% C, below 0.35% Si, below 1.65% Mn, below 3.5% F and Ni, below 3.5% Cr, below 0.35% Mo, 0.010–0.10% Al and below 0.002% B.

When Ca is incorporated in the steel, various sulfides or oxides are produced and it serves to positively convert inclusions into CaO, CaS and (Ca,Mn)S and also to reduce $Al_2O_3$ to a considerable extent. Accordingly, it is necessary to add large amounts of Ca. If the content of Ca at the stage of steel product is less than 0.0005%, the above effects are not satisfactory. The effects are developed when the amount is larger than 0.001%. When the content exceeds 0.05%, the CaO inclusion is formed too much, which gives an adverse influence on the cold forgeability. In this sense, the content below 0.01% is preferable.

The content of S over 0.12% results in formation of sulfides in large amounts, leading to deterioration of the cold forgeability. Accordingly, S is in the range below 0.12%, preferably below 0.8%. Most preferably, the content of S is below 0.005% because of the remarkable improvement of the cold forgeability.

Pb and Bi are elements which serve to improve the machinability. When the content of one or both of Pb and Bi exceeds 0.2%, the cold forgeability becomes poor. Accordingly, the content is below 0.2%. In order to collectively improve the cold forgeability and machinability, the optimum range in content of at least one component is 0.02–0.12%.

In the steel of the invention, three types of the sulfides are present including CaS, (Ca,Mn)S and MnS and it is desirable to reduce the MnS to a degree as small as possible since it is elongated at the time of rolling thereby deteriorating the cold forgeability. It will be noted that CaS and (Ca,Mn)S may be present in the form of two phases associated with the CaO inclusion. In order to improve the cold forgeability, the rate of the CaS, (Ca,Mn)S and CaO inclusions by area percentage under the field of optical microscope (e.g. by the cleanliness steel as prescribed in JIS G0555) should preferably be in the range of above 70% of the total inclusions except the Pb-base or Bi-base inclusion.

$Al_2O_3$ is so hard that the abrasion of tool is accelerated upon cutting and thus the machinability is lowered and it also serves to cause the development of incipient cracks at the time of cold forging. Accordingly, its content is below 0.002%, preferably below 0.0005%.

The present invention are particularly described by way of example.

EXAMPLE

In Table, there are shown constituents and their contents of steels (based on AISI 1045) used in this test.

Each steel sample were rolled into rods of 80 mmϕ and 25 mmϕ for the cutting and cold forging tests, respectively, and used for the tests after normalizing treatment.

(1) Cold Forging Test

Test Piece: 20 mmϕ×30 mm;

Test pieces were each subjected to the constrained compression to determine a relation between the compressibility and the rate of occurrence of cracks, from which a critical upsetting rate at which 50% of tested smaples were cracked was determined. The steel with a greater critical upsetting rate is better in cold forgeability. The compressibility is calculated from the following equation.

$$\text{Compressibility} = \frac{H_o - H}{H_o} \times 100\ (\%)$$

in which $H_o$: Height of test piece before compression

H: Height of the test piece after constrained compression

(2) Cutting Test

Cutting Speed: 50, 100, 150, 200, 250 (m/min)

Feed: 0.05, 0.125, 0.175, 0.25 (mm/reve)

Cut: 1.5 mm (constant)

Cutting Oil: Nil.

Test pieces were cut under these 20 test conditions using a lathe set with a cemented carbide cutting tool P 10 and their susceptibility to cutting was evaluated from the form of produced chips.

| Form of Chips | Evaluation Point |
|---|---|
| Broken finely and gyrated less than once | 40 |
| Gyrated twice or three times | 30 |
| Curled regularly and continuously | 20 |
| Irregular without curling | 10 |

These evaluation points determined under the 20 conditions were summed up. Higher point is more excellent in machinability.

The test results of the cold forgeability and machinability are shown in FIG. 1. As is apparent from the FIG. 1, when the content S is increased, the cold forgeability is lowered and the machinability is increased both in the steels of the invention and the known steels. However, the steels of the invention is superior in both the cold forgeability and machinability to the known steels. It is to be noted that when the content of S exceeds 0.120%, almost no effects are produced even when Ca is incorporated similarly to the case of the steels of the invention (C5 and C10).

Then, several samples were subjected to the measurement of cleanliness using EPMA and an optical microscope, with the results shown in Table 2.

Figure 2:
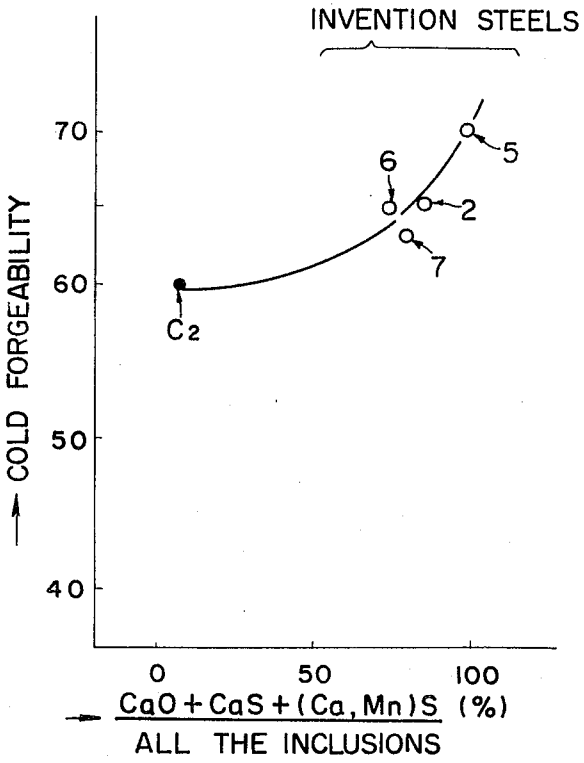
FIG. 2 is a relation between the ratio in area of CaO+CaS+(Ca, Mn)S inclusions to all the inclusions and the cold forgeability.

The steels of the invention show greater ratios of area occupied by the C-system inclusions, i.e. CaO+CaS+-(Ca,Mn)S. In FIG. 2, there is shown a relation between the ratio of area occupied by the CaO+CaS+-(Ca,Mn)S inclusions and the cold forgeability. The greater area occupied by these inclusions results in more improved cold forgeability. The satisfactory results are obtained when the ratio is over 70%.

Figure 3:
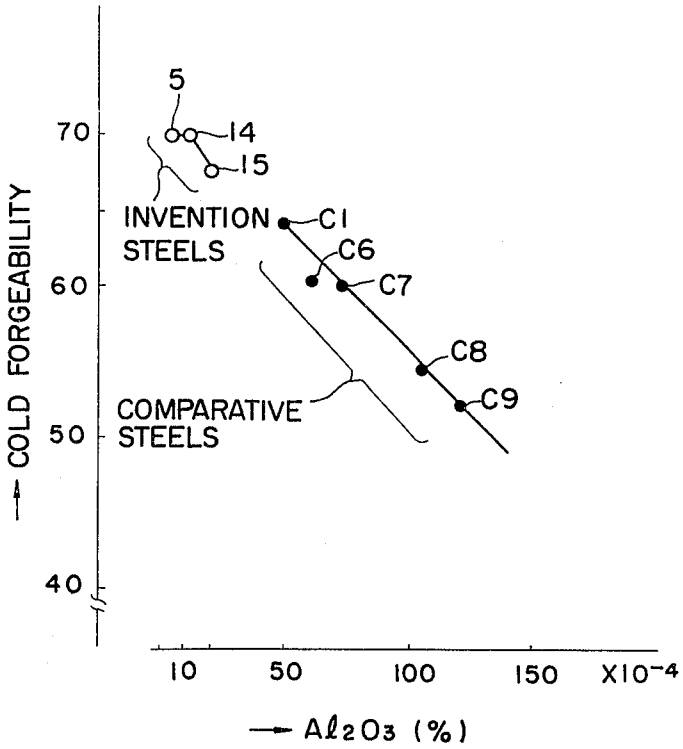
FIG. 3 is a relation between the content of $Al_2O_3$ inclusion and the cold forgeability.

FIG. 3 shows a relation between the content of $Al_2O_3$ inclusion in steels and the cold forgeability, from which it will be seen that the known steels contain 0.005–0.012% of $Al_2O_3$ inclusion while the steels of the invention contain below 0.002% of $AL_2O_3$ inclusion with the cold forgeability being improved.

Figure 4:
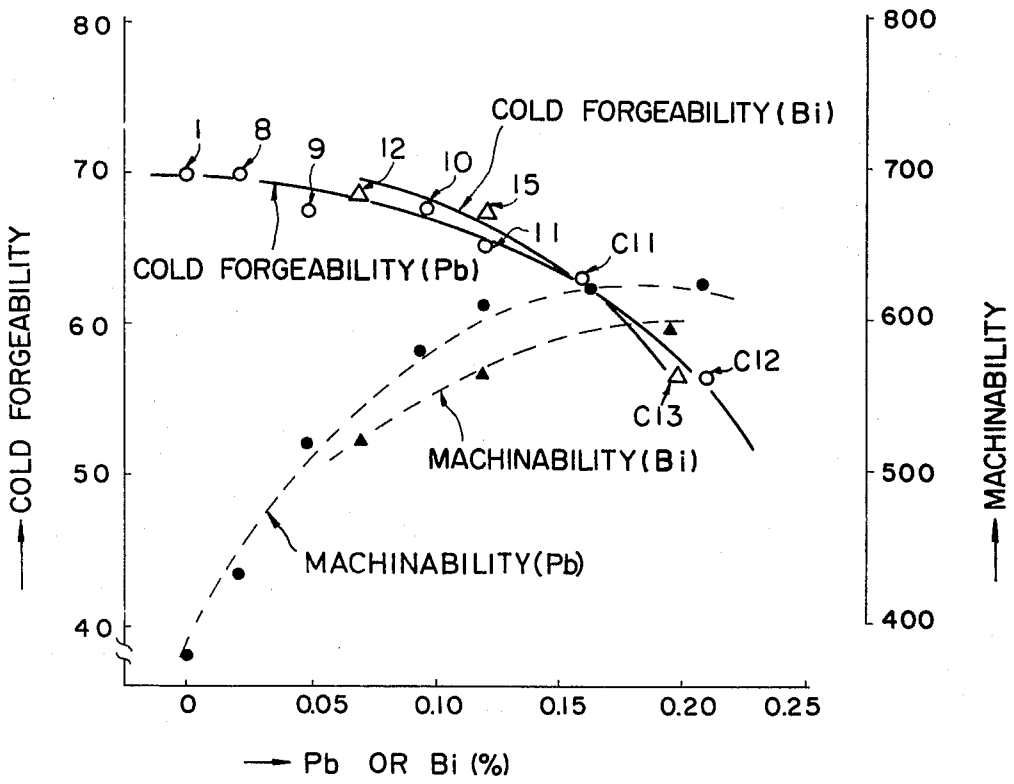
FIG. 4 is relations between the cold forgeability and machinability and the content of Pb or Bi.

FIG. 4 shows a relation between the content of Pb or Bi and the cold forgeability and machinability. As the content of Pb or Bi is increased, the cold forgeability is gradually lowered and the deterioration becomes fair over 0.12% and very considerble over 0.20%. On the other hand, the machinability increases with an increase of the content and saturated at 0.12%.

TABLE 1

| | NO. | Chemical Composition | | | | | | | | | |
|---|---|---|---|---|---|---|---|---|---|---|---|
| | | C | Si | Mn | P | S | Ca | Pb | Bi | sol.Al | $Al_2O_3$ |
| Invention Steels | 1 | 0.46 | 0.24 | 0.76 | 0.016 | 0.001 | 0.005 | — | — | 0.043 | <0.0005 |
| | 2 | 0.44 | 0.22 | 0.78 | 0.015 | 0.019 | 0.006 | — | — | 0.049 | |
| | 3 | 0.43 | 0.20 | 0.80 | 0.013 | 0.056 | 0.003 | — | — | 0.034 | 0.001 |
| | 4 | 0.42 | 0.17 | 0.81 | 0.013 | 0.117 | 0.008 | — | — | 0.032 | 0.002 |
| | 5 | 0.45 | 0.19 | 0.79 | 0.013 | 0.001 | 0.002 | — | — | 0.039 | <0.0005 |
| | 6 | 0.44 | 0.24 | 0.87 | 0.015 | 0.021 | 0.004 | — | — | 0.041 | <0.0005 |
| | 7 | 0.44 | 0.21 | 0.76 | 0.013 | 0.034 | 0.008 | — | — | 0.034 | 0.001 |
| | 8 | 0.47 | 0.22 | 0.81 | 0.012 | 0.001 | 0.005 | 0.02 | — | 0.040 | 0.001 |
| | 9 | 0.46 | 0.26 | 0.91 | 0.016 | 0.002 | 0.006 | 0.05 | — | 0.056 | 0.002 |
| | 10 | 0.45 | 0.24 | 0.75 | 0.018 | 0.001 | 0.005 | 0.09 | — | 0.040 | <0.0005 |
| | 11 | 0.43 | 0.21 | 0.80 | 0.013 | 0.001 | 0.004 | 0.12 | — | 0.020 | 0.001 |
| | 12 | 0.43 | 0.26 | 0.74 | 0.017 | 0.001 | 0.004 | — | 0.07 | 0.055 | 0.002 |
| | 13 | 0.44 | 0.25 | 0.77 | 0.018 | 0.001 | 0.007 | — | 0.12 | 0.032 | <0.0005 |
| | 14 | 0.45 | 0.20 | 0.82 | 0.020 | 0.002 | 0.005 | — | — | 0.048 | 0.001 |
| | 15 | 0.47 | 0.18 | 0.78 | 0.017 | 0.001 | 0.004 | — | — | 0.048 | 0.002 |
| Comparative Steels | C1 | 0.44 | 0.23 | 0.78 | 0.019 | 0.001 | — | — | — | 0.054 | 0.050 |
| | C2 | 0.45 | 0.20 | 0.72 | 0.022 | 0.020 | — | — | — | 0.035 | 0.071 |
| | C3 | 0.46 | 0.22 | 0.62 | 0.021 | 0.058 | — | — | — | 0.042 | 0.055 |
| | C4 | 0.44 | 0.24 | 0.71 | 0.020 | 0.122 | — | — | — | 0.049 | 0.044 |
| | C5 | 0.43 | 0.25 | 0.74 | 0.022 | 0.203 | — | — | — | 0.057 | 0.052 |
| | C6 | 0.46 | 0.25 | 0.78 | 0.022 | 0.004 | — | — | — | 0.055 | 0.062 |
| | C7 | 0.43 | 0.24 | 0.70 | 0.022 | 0.003 | — | — | — | 0.035 | 0.071 |
| | C8 | 0.45 | 0.25 | 0.77 | 0.022 | 0.003 | — | — | — | 0.034 | 0.0105 |
| | C9 | 0.43 | 0.19 | 0.69 | 0.017 | 0.001 | — | — | — | 0.041 | 0.0120 |
| | C10 | 0.45 | 0.28 | 0.86 | 0.011 | 0.202 | 0.012 | — | — | 0.043 | 0.002 |
| | C11 | 0.45 | 0.19 | 0.76 | 0.013 | 0.003 | 0.007 | 0.16 | — | 0.028 | 0.001 |
| | C12 | 0.47 | 0.28 | 0.84 | 0.016 | 0.002 | 0.006 | 0.21 | — | 0.042 | 0.002 |
| | C13 | 0.44 | 0.27 | 0.81 | 0.013 | 0.001 | 0.005 | — | 0.20 | 0.031 | 0.001 |

TABLE 2

| | NO. | Cleanliness (%) | | | | | |
|---|---|---|---|---|---|---|---|
| | | dAI (MnS) | dAII (Silicate) | dB ($Al_2O_3$) | dC CaS, (Ca, Mn) S, CaO | d (Total) | $\frac{dC}{d} \times 100$ (%) |
| Invention Steels | 2 | 0.02 | 0 | 0 | 0.10 | 0.12 | 83 |
| Invention Steels | 5 | 0 | 0 | 0 | 0.03 | 0.03 | 100 |
| Invention Steels | 6 | 0.03 | 0 | 0 | 0.09 | 0.12 | 75 |
| Invention Steels | 7 | 0.03 | 0 | 0 | 0.12 | 0.15 | 80 |
| Comparative Steels | C2 | 0.10 | 0 | 0.02 | 0.01 | 0.13 | 8 |

What is claimed is:

1. A steel for machine construction having excellent cold forgeability and machinability which has a composition of less than 0.6% C., less than 0.35% Si, less than 1.65% Mn, less than 3.5% Ni, less than 3.5% Cr, less than 0.35% Mo, 0.010–0.10% Al, and less than 0.002% B, the remainder being Fe and impurities with limited contents of Pb and/or Bi within the range of 0.02–0.12%, Ca in the range of greater of 0.001% and less than or equal to 0.05%, S of less than 0.005%, $Al_2O_3$ inclusion of less than 0.0005% and inclusions substantially composed of CaO, CaS, (Ca, Mn)S and MnS, wherein the area percentage of the CaO, CaS and (Ca, Mn)S inclusions based on all the inclusions except the Pb- or Bi-based inclusion is over 70%.

* * * * *